US005187329A

United States Patent [19]

Bleich et al.

[11] Patent Number: 5,187,329

[45] Date of Patent: Feb. 16, 1993

[54] TWISTED PAIRS OF INSULATED METALLIC CONDUCTORS FOR TRANSMITTING HIGH FREQUENCY SIGNALS

[75] Inventors: Larry L. Bleich, Omaha, Nebr.; Wendell G. Nutt, Dunwoody, Ga.; Stephen T. Zerbs, Gretna, Nebr.

[73] Assignee: AT&T Bell Laboratories, Murray Hill, N.J.

[21] Appl. No.: 722,786

[22] Filed: Jun. 28, 1991

[51] Int. Cl.[5] ..... H01B 11/00

[52] U.S. Cl. ..... 174/113 R; 174/34; 174/112

[58] Field of Search ..... 174/34, 32, 112, 113 R, 174/117 R

[56] References Cited

U.S. PATENT DOCUMENTS

| | | | |
|---|---|---|---|
| 3,031,524 | 4/1962 | Hicks | 174/112 |
| 4,128,736 | 12/1978 | Nutt et al. | 174/112 |
| 4,486,619 | 12/1984 | Trine et al. | 174/34 |
| 4,697,051 | 9/1987 | Beggs et al. | 174/34 X |
| 4,873,393 | 10/1989 | Friesen et al. | 174/34 |
| 4,887,645 | 10/1989 | Bleich et al. | 427/117 |
| 5,015,800 | 5/1991 | Vaupotic et al. | 174/34 |
| 5,024,864 | 6/1991 | Bleich et al. | 427/424 |

FOREIGN PATENT DOCUMENTS

| | | | |
|---|---|---|---|
| 1136419 | 12/1968 | United Kingdom | 174/112 |

OTHER PUBLICATIONS

Proceedings of the 1976 International Wire and Cable Symposium, Judy, A. F and Refi, J. J., "Effect of Pair Unbalance On Carrier Frequency Insertion Loss and Cross Talk In Multipair Cable".

*Primary Examiner*—Morris H. Nimmo

*Attorney, Agent, or Firm*—D. E. Hayes, Jr.; E. W. Somers

[57] ABSTRACT

Methods and apparatus are provided for providing an electrically matched pair (20) of insulated metallic conductors (21,21). Insulation is applied to successive portions of a length of wire-like metallic conductor (22) after which a colorant material (37) is applied to the surface of a plastic insulation material of a first portion of the length of the metallic conductor which is being moved along a path of travel. Facilities are provided for shielding a supply of the colorant material from the moving insulated metalic conductor and for then exposing a second portion of the length of the insulated metallic conductor to a different colorant material. The insulation and the colorant materials and their disposition with respect to the insulation are such that the dielectric constant of one insulated metallic conductor of the pair is substantially equal to that of the other. The first and second portions of the length of the insulated metallic conductor are separated from each other and are twisted together to provide an electrically matched pair.

7 Claims, 3 Drawing Sheets

TWISTED PAIRS OF INSULATED METALLIC CONDUCTORS FOR TRANSMITTING HIGH FREQUENCY SIGNALS

TECHNICAL FIELD

This invention relates to twisted pairs of insulated metallic conductors for transmitting high frequency signals and methods of making same. More particularly, this invention relates to methods of causing portions of a single conductor length which is run through an extruder whereat insulation is applied to have different colors after which the portions are separated from each other and twisted together to provide an electrically matched pair.

BACKGROUND OF THE INVENTION

A technical objective, that is also economically important, is to be able to make a cable comprising a twisted insulated metallic conductor pair or pairs as small as possible that is capable of transmitting data at a maximum rate. In order to provide a twisted pair cable being capable of transmitting digital signals at the highest rate for the maximum distance and also being as small as possible, insulating material with relatively low dielectric constant and low power factor is sought for the metallic conductor.

The advantages of relatively high bit rate transmission can be realized only if electrically balanced pairs can be produced. Pair balance means that one insulated conductor of a pair should be substantially identical to the other—a difficult objective. In addition to a good pair balance, maximizing both bit rate transmission and distance capability requires suitable crosstalk control. This carries with it a need for short pair twists which enhance the electrical characteristics of the pair as well as preventing the pairs from becoming untwisted.

Also desired is the ability to distinguish one conductor of a pair from another by sight. There is a basic conflict between the sight coding of insulated conductors and pair balance needed to provide electrically matched pairs. Sight coding involves making one insulated conductor of a pair appear differently from the other insulated conductor of the same pair. Striving for the required pair balance involves making one insulated conductor of a pair identical in every respect except appearance to the other conductor. The very best pair balances have been achieved with electrically matched pairs, i.e. the two insulated conductors of a pair taken successively from a single length of wire on the same insulating manufacturing line. Although electrically matched pairs produce the very best pair balance, the two resulting conductors have had the same color thereby making it impossible to sight distinguish between them.

Of importance with respect to colored insulation are electrical properties of cable which include such insulated conductors. One electrical property is capacitance. Capacitance is an effect somewhat similar to the magnetic field known to exist around a current-carrying conductor. The capacitive effect results from electrostatic charges on adjacent surfaces, such as metallic conductors in a pair or pairs. Electronic wires and cables by nature develop capacitive effects whenever current is flowing. Although it is impossible to eliminate capacitance, certain factors can be adjusted to achieve an acceptable level.

It is known that the inclusion of different colorant pigments in the composition of the insulation for purposes of distinguishing one conductor of a pair from the other compromises the electrical properties of the insulated conductor discussed hereinbefore. Conductor insulation which has a pigment dispersed throughout adversely affects electrical properties such as capacitance. Pigments of different color concentrates affect capacitance and processing differently. Achieving lower capacitance values has resulted in higher manufacturing costs whereas higher values cause increased attenuation.

The problems of the application of colorant materials to a moving insulated metallic conductor and of the effect of pigments dispersed throughout the insulation on electrical properties of the insulated conductor have been solved by the application of a colorant material to the surface of a moving insulated conductor which may be referred to as topcoating, for example. One such process is described in U.S. Pat. No. 4,877,645 which issued on Oct. 31, 1989 in the names of L. L. Bleich, J. A. Roberts and S. T. Zerbs. Relative motion is caused to occur between an insulated conductor and a source of a colorant material in a direction along a longitudinal axis of the insulated conductor. Colorant material is directed in spray patterns toward the insulated conductor in such a manner that substantially all the surface area of the insulated conductor is covered therewith. A first plurality of the spray patterns is such that each spray thereof occupies only an area of a plane and is at a predetermined angle to the longitudinal axis of the insulated conductor with the first plurality being disposed between a colorant supply head and a takeup. A second plurality of spray patterns may be disposed between the colorant supply head and a payoff. Each of the second plurality of spray patterns is fully conical. The first and the second pluralities of the spray patterns are arranged and spaced along the longitudinal axis of the insulated conductor.

Topcoating materially reduces scrap rates because the coloring is applied to the outside of the just-insulated conductor and therefore obviates the need to adjust insulating conditions for different colors and also the wasteful purging of an extruder for a color change.

With topcoating, it may be necessary first to tint the insulation with white color concentrates to hide the copper conductor. Here, it may be noted that copper wire can vary significantly from the familiar bright, shiny copper color to a dark, purplish brown. Because many desirable insulating materials are fairly transparent, providing a constant white base is helpful in achieving bright, easily distinguished colors. Placed on a white plastic material, for example, a topcoating satisfactorily produces readily distinguishable colors with acceptable adherence to the insulation and can be produced with acceptable processing yields.

Other processes for applying a colorant material to an outer surface of the insulation are known. For example, colorant material may be applied in periodic band marks around the circumference of the insulation or as a longitudinal stripe on the outer surface of the insulation.

The state of the art then is that there exist excellent materials which may be used for insulation as well as methods for causing these conductors to be identifiable. These materials and methods of coloring are advances in the quest for insulated metallic conductors which can transmit digital signals over long distances at the highest rate.

What is sought after and what seemingly is not provided for in the prior art is an electrically matched insulated metallic conductor pair in which the two insulated conductors of a pair are distinguishable. Desirably the matched pair is made from successive portions of a single length of metallic wire which is processed in sequential steps on an insulating line. Further what is sought after is a differentiation between the conductors of the pair without adversely affecting electrical properties of the insulated metallic conductors.

SUMMARY OF THE INVENTION

The foregoing problems of the prior art have been overcome by the electrically matched insulated metallic conductor twisted pair of this invention and by methods of making same. An electrically matched insulated metallic conductor twisted pair includes first and second insulated metallic conductors each comprising a metallic conductor and an insulation material which covers the metallic conductor. The first and second insulated conductors are visually distinguishable from each other.

In a preferred embodiment, the insulation material comprises a composition of matter which is at least substantially non-porous. Further, the first insulated metallic conductor of the preferred embodiment includes a surface layer of a colorant material which encloses the insulation material, which facilitates identification of the first insulated conductor and which is confined substantially to an outer surface of the insulation cover. Further, the second insulated metallic conductor of the preferred embodiment includes a surface layer of a colorant material which encloses and which is confined substantially to an outer surface of the insulation material of the second insulated conductor. Further, the colorant material of the second insulated conductor of the preferred embodiment is such as to cause the second conductor to be distinguishable from the first conductor.

The first and the second insulated conductors comprise successive portions of a continuous length of metallic wire which has been insulated in a single run. Further, the first and second insulated conductors are such that the dielectric constants of the insulation and any means of distinguishment of each are substantially equal.

In a method of making an electrically matched insulated metallic conductor twisted pair, a length of a metallic conductor wire is payed out from a supply and caused to have an insulation material applied thereto. In a preferred embodiment, the insulation material comprises a composition of matter which is at least substantially non-porous. A surface layer of a colorant material is applied by a coloring head to the insulation material which has been extruded onto the moving wire for a first portion of the length of the wire. Then a shield is caused to be interposed between the coloring head and the insulated conductor while the wire is exposed either to another coloring head or is allowed to maintain a tint color. The other coloring head causes another colorant material to be applied to a second portion of the length the moving wire. Pigment variability between colors is spaced as far as possible from the metallic conductor to reduce capacitance variability. The dielectric constant of the insulation and colorant material on each insulated conductor is substantially identical. Afterwards, the first portion of the length of the wire is separated from the second portion and the first and the second portions are caused to be twisted together to provide an electrically matched pair.

BRIEF DESCRIPTION OF THE DRAWING

Other features of the present invention will be more readily understood from the following detailed description of specific embodiments thereof when read in conjunction with the accompanying drawings, in which.

DETAILED DESCRIPTION

Figure 1:
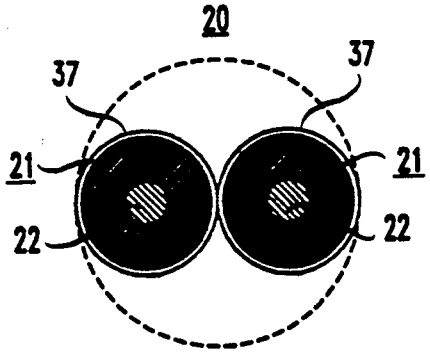
FIG. 1 is an end cross sectional view of an insulated metallic conductor twisted pair which has been enclosed with plastic insulation material and provided with a surface colorant.

Referring now to FIG. 1, there is shown an electrically matched insulated metallic conductor twisted pair designated generally by the numeral 20. The twisted pair 20 includes two identifiable insulated metallic conductors 21—21, each including a metallic conductive portion 22, which have been twisted together with a desired twist length. Each insulated conductor of the pair is visually distinguishable from the other conductor of the pair.

Capacitance balance or unbalance of twisted pairs has long been studied in connection with combating interferences to voice and carrier frequencies. However, one aspect of capacitance balance, balanced dielectric constant, becomes increasingly important as the transmitted frequencies increase. Twisted pairs now are to be used to transmit 100 megabit per second Fiber Distributed Data Interface (FDDI) signals and have been shown to be suitable to transmit one gigabit per second signals. It will be of importance in transmitting these frequencies that the distinguishable insulations of the two conductors of a pair have nearly identical dielectric constants.

Figure 2:
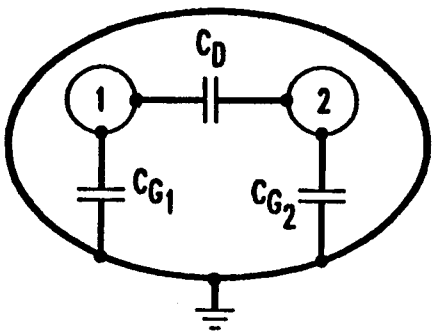
FIG. 2 is an electrical schematic representation of two conductors and a shield and showing the capacitance between metallic elements thereof.

Referring now to FIG. 2 the mutual capacitance of an insulated metallic conductor pair is the sum of the capacitance of one conductor to the other, $C_D$, and the series combination of the capacitance of each conductor to earth. The capacitance of one conductor of the pair to the other conductor, is important but does not contribute to the capacitance to earth. A twisted pair is said to have perfect capacitance balance if the capacitance of one conductor to earth, $C_{G1}$, is equal to the capacitance of the other conductor to earth, $C_{G2}$. Assuming that the elements of the pair are circular and concentric, the capacitance to earth is a function of the conductor diameter, the insulation diameter, the distance of the pair to ground or to a shield, and the dielectric constant of the insulation. From voice frequencies to about 100 kHz, simple capacitance balance is adequate to cancel interferences. However, differences in the dielectric constant of the insulations of the two conductors become increasingly important, possibly even controlling, as the transmitted frequencies increase and as the series combination of the capacitance of each conductor to earth increases.

The importance of equal dielectric constant between insulated conductors of a pair is a function of two parameters, i.e. the system in which the pair is to be used and the pair design. As will be discused hereinafter, a measure of the system importance is the number of wavelengths between a signal source and a receiver.

With regard to pair design, equal dielectric constant of the insulations of the two conductors is least important in designs in which most of the mutual capacitance is due to the capacitance between conductors and is most important in designs in which most of the mutual capacitance is due to the capacitances of the conductors to ground. In other words, the sensitivity of a design to variation in dielectric constant is measured by the ratio $C_{G1}/C_D$ or $C_{G2}/C_D$. An unshielded twisted pair suspended in air represents a design least susceptible to dielectric constant variations. An individually shielded pair represents a design most susceptible to these variations. While the two extreme designs may differ by an order of magnitude in their susceptibility, uniform dielectric constant becomes important for any twisted pair design when transmitting at very high bit rates. The greater the proportion of mutual capacitance that is due to the series combination of capacitance of each conductor to earth, the more important it becomes to have equality between the dielectric constants of the conductor insulation covers of a twisted pair.

A pair design which has mutual capacitance consisting solely of capacitance to ground without any direct conductor-to-conductor capacitance may be formed by twisting together two coaxial cables. It is well known that a high frequency signal in a coaxial cable propagates at the velocity of light divided by the square root of the dielectric constant. Consider two cases. The first is one in which the frequency and the distance between signal source and receiver are such that there are 10 wavelengths in the span, and the second is one in which the frequency and distance between signal source and receiver are such that there are 100 wavelengths in the span. In the first case there is 3,600° of phase shift between source and receiver. In the second case there is 36,000° of phase shift between source and receiver. If a phase difference of, say, 6° is critical, the first system requires that the signal velocities of the two conductors be matched to 6/3,600, or one part in 600. The second system requires that the signal velocities be matched to 6/36,000 or one part in 6000. Thus, it is clear that the greater the number of wavelengths between signal source and receiver, the more critical becomes the match between the phase velocities, and therefore the dielectric constants, of the two insulated conductors of a pair.

Good pair balance entails the same ratio of the diameter of the insulated conductor to the diameter of the metallic conductor for both insulated conductors and substantially the same dielectric constant, both of which are achieved with the present invention. A uniform dielectric constant is especially critical because each conductor of the pair carries half the signal and each half must maintain its phase with respect to the other half. A uniform dielectric constant may be achieved by causing the conductor insulation and any distinguishment means such as colorant material to be uniform along the two lengths which comprise the twisted pair.

Figure 3:
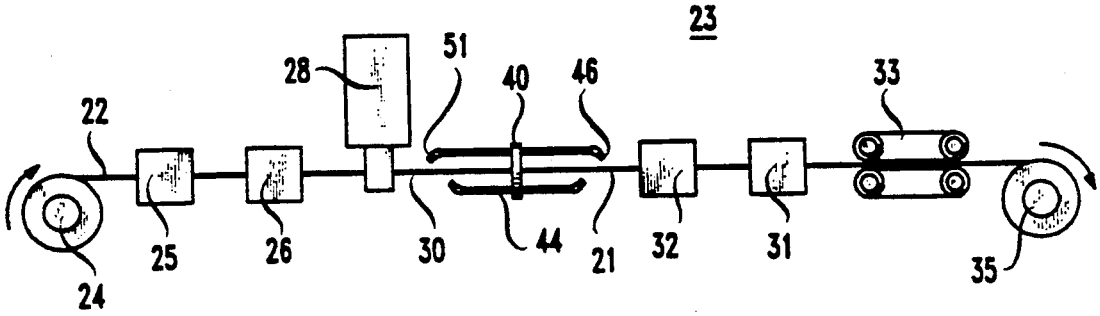
FIG. 3 is a schematic view of a manufacturing line for making a continuous length of insulated metallic conductor having successive portions thereof colored differently.

Going now to FIG. 3, a wire-like metallic conductor 22 is moved along an insulating line 23 from a supply reel 24 and advanced through a drawing apparatus 25 wherein the diameter of the wire is reduced. Thereafter, it is annealed in an annealer 26, then cooled and reheated to a desired temperature after which is it moved into and through an extruder 28.

In the extruder 28, a plastic insulating material is applied to the moving wire to enclose it to provide an insulated metallic conductor 30. The details of the structure of the drawing apparatus, annealer and extruder are all well known in the art and do not require elaboration herein. Afterwards, the plastic insulated wire is moved through a cooling trough 31 by a capstan 33 and onto a takeup 35. A conventional marking device 32 may be used to apply a band marking to the insulation.

Desirably, the insulating material is a clear or neutral color or a white color plastic fluoropolymer material. With these criteria in mind, Teflon ® plastic material is clearly an example of one of the best available insulation materials. Also, it is an excellent material in terms of strength, resistance to chemical attack and fire retardancy. In the preferred embodiment, the insulating material may be perfluoroalkoxytetrafluoroethylene (PFA), fluorinated ethylene-propylene (FEP) or ethylene tetrafluoroethylene copolymer (ETFE).

Teflon plastic material can be pigmented with a white color concentrate. Some advantages of having only a white color insulation are ease of processability, ease of coloring, hiding power of copper variability and uniformity of electrical properties. Some color concentrates other than white are more difficult to process. Also, a complete palette of colors made using color concentrates would entail unwanted variations in dielectric properties.

There are insulation materials other than Teflon plastic which will benefit from this manufacturing process and will provide similar electrical advantages. Other such insulation materials include polyethylene, polypropylene, and HALAR ® fluoropolymer.

Teflon plastic material has proven difficult to color by pigmenting throughout the insulation with color concentrates. Color concentrates for colors that present the most problems have two melt phases. If temperatures are raised enough to obtain complete melting, gases are produced; at lower temperatures, small unmelted chunks appear as inclusions in the insulation.

Variability between different colored color concentrates, which typically have been included in the insulation, causes variations in capacitance. However, the greater the distance from the metallic conductor, the less effect there is on the capacitance. Thus, pigment variability for a topcoated insulated conductor has an insignificant effect on the capacitance of the pair because of the distance of the surface coating to the metallic conductors.

Between the extruder 28 and the takeup 35, a colorant material 37 (see FIG. 1) is applied such as in a layer to an outer surface the plastic insulated wire and provide an identifiable insulated conductor 21. The location along the line 23 where it is applied depends on the kind of plastic material comprising the extrudate. Inasmuch as in the preferred embodiment, the insulation comprises a fluoropolymer, which is non-porous, the colorant material is applied at a location between the extruder 28 and the cooling trough 31.

Notwithstanding its location, a colorant material application apparatus 40 is included in the line 23 and is effective to apply a colorant material to cover substantially the entire surface area of the moving insulated conductor 30. Advantageously, the application apparatus 40 is a non-contact device. Preferably, the colorant material is an ink such as No. 3516, for example, commercially available from GEM Gravure Co. of West Hanover, Mass.

Figure 4:
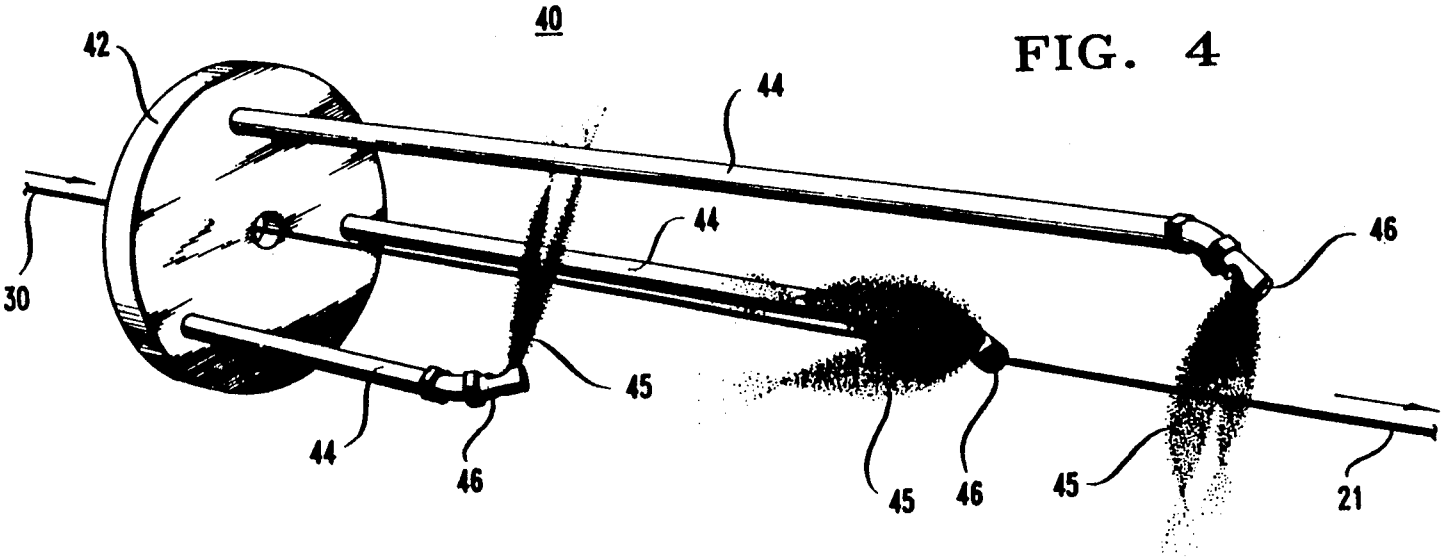
FIG. 4 is a perspective view of apparatus for applying a colorant material to a moving insulated metallic conductor.

As can best be seen in FIG. 4, the apparatus 40 includes a manifold head 42 which is connected to a source of supply (not shown) of colorant material. The manifold head 42 has an annular shape to allow the plastic insulated conductor to be advanced therethrough. Extending from one side of the manifold head 42 are a plurality of tubular support members 44—44 which are connected through the manifold head to the source of supply. Attached to each tubular member 44 is a nozzle 46 which has an entry port that communicates with the passageway through its associated tubular member.

Each nozzle 46 is one which is adapted to provide a particular spray pattern of the colorant. Preferably the nozzle 46 emits colorant material therefrom in a single plane or sheet 45 (see FIGS. 4 and 5).

Also, each nozzle 46 is positioned on its associated tubular member to emit its spray in a plane which is at a particular angle $\alpha$ (see FIG. 5) to the path of travel of the plastic insulated wire. The angle $\alpha$ is such that the spray has a component parallel to the path of travel of the insulated wire but in a direction opposite to the direction of movement of the insulated wire. Preferably, that angle $\alpha$ is in the range of about 105° to 135°. Because of the direction of the spray pattern, the velocity components tend to provide a smoothing action on the ink and thereby prevent excessive buildup. The result is a surface having a substantially uniform coating thereon.

Figure 5:
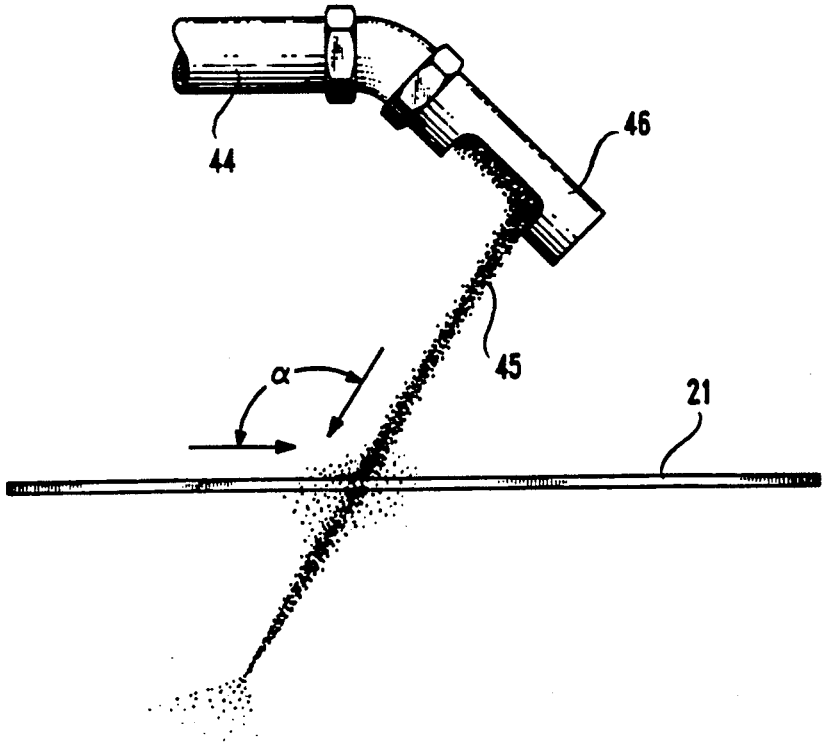
FIG. 5 is an enlarged view of one of a plurality of nozzles for supplying a colorant material to a moving insulated metallic conductor.

It should be also observed that in addition to the predetermined angle at which the nozzles are disposed, there are other factors about their positions which are important (see again FIGS. 4 and 5). First, the nozzles are staggered along the path of travel of the plastic insulated wire. The staggered arrangement prevents interference among the spray patterns. Secondly, the nozzles are generally equiangularly spaced about the periphery of the plastic insulated wire. Thirdly, each of the nozzles is spaced about one half inch from the path of travel of the insulated wire. It has been found that as the distance increases beyond one half inch, less coverage of the plastic insulation with the ink is experienced.

Movement of the nozzles toward or away from the insulated wire 21 may be accomplished with an arrangement depicted in the aforementioned U.S. Pat. No. 4,877,645.

The nozzles 46—46 also are advantageous from another standpoint. Important to the uniform coating of the plastic insulation is its improved stability against undesired undulations as it is advanced through the applicator apparatus. It has been found that because of the spray patterns emitted from the nozzles 46—46, the plastic insulated wire is substantially free of any undulations from its desired path.

It should be observed from the drawings that the nozzles 46—46 are disposed between the manifold head 42 and the takeup. It has been found that the coloring operation is enhanced by disposing a second plurality 51 of spray nozzles (see FIG. 6) between the manifold head 42 and the extruder 28. Each of the nozzles of the second plurality 51 is designated by the numberal 50.

Unlike the nozzles 46—46, each of the nozzles 50—50 provides a solid cone-shaped spray pattern 53 of the colorant material. Each nozzle 50 provides a uniform spray of medium to large size droplets. Such a nozzle is commercially available, for example, from the Spraying System Company of Wheaton, Ill. under the designation Full Jet® nozzle. Spray angles between opposed lines on the outer surface of the spray pattern may be in the range of from about 40° to about 110°.

Figure 6:
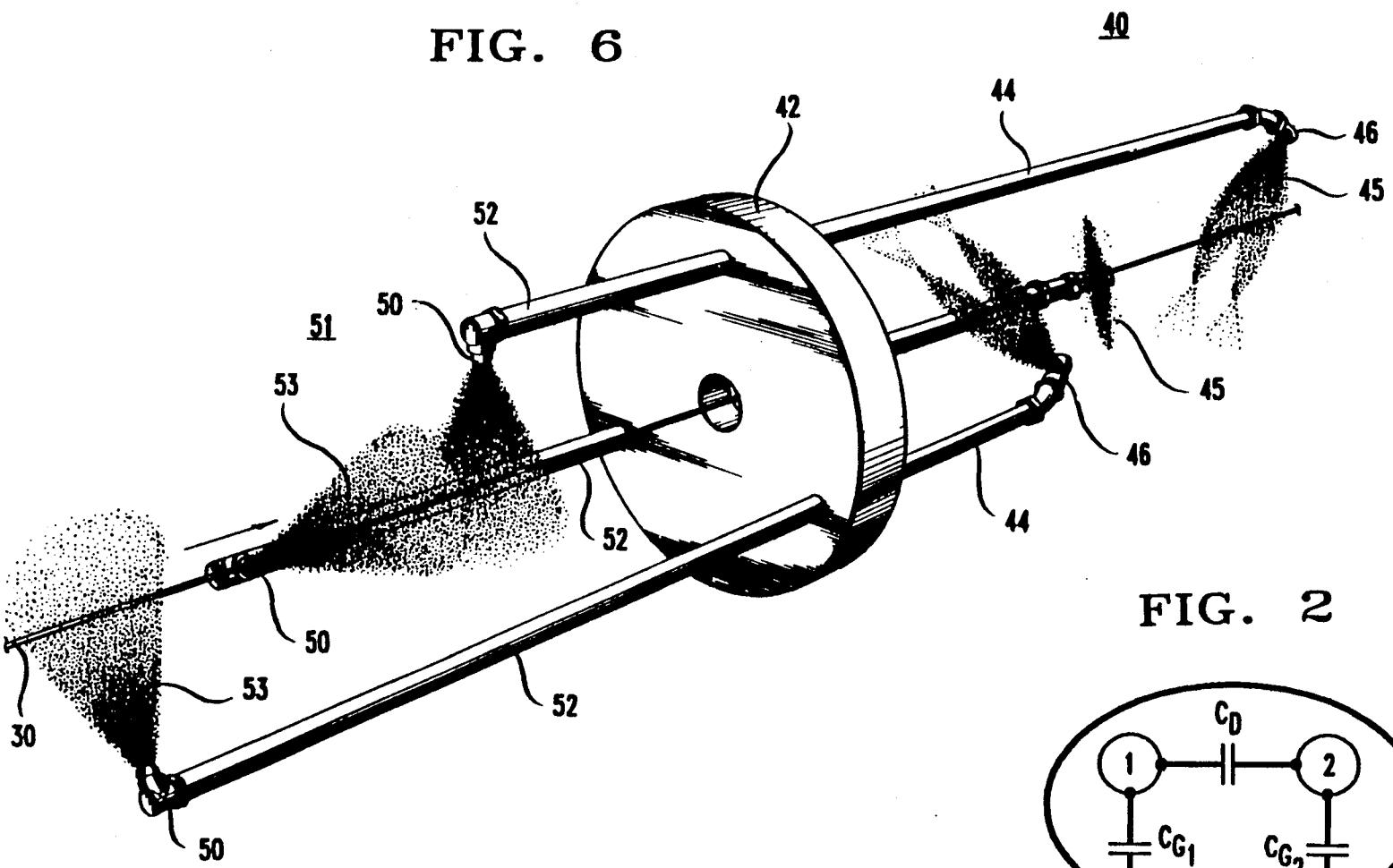
FIG. 6 is a perspective view of an arrangement of two sets of nozzles for applying a colorant material to a moving insulated metallic conductor.

Also as can be seen in FIG. 6, each nozzle 50 is supported from a tubular member 52 which projects from the manifold head 42. Colorant material provided to the head 42 is caused to flow through each of the tubular members 52—52 and to the nozzles 50—50.

The nozzles 50—50 are disposed to reduce interference among the spray patterns and to enhance the coverage of the colorant material on the surface of the plastic insulated wire. As can be seen in FIG. 6, the nozzles are staggered along the path of travel of the plastic insulated wire such that the spray patterns are spaced apart. Also, the nozzles 50—50 are arranged about the path of travel of the insulated wire so that each is directed in a different radial direction and preferably so that they are spaced equiangularly about the moving wire.

Although the nozzles 50—50 enhance the coverage of the surface area of the plastic insulation, they also tend to cause undulatory movement of the traveling insulated wire. However, this effect is muted by the nozzles 46—46 each of which provides a sheet spray.

The system of this invention includes facilities for effecting cutover from one colorant material to another as the insulated wire continues to be moved along the path of travel. A second manifold head 58 (see FIG. 7) identical to the manifold head 42 and having first and second pluralities of nozzles is provided. Further, a shroud 60 which is mounted for reciprocal movement by an air cylinder 62, for example, is interposed between the two manifold heads. The manifold head 58 is operative to supply colorant to its associated nozzles to coat the wire insulation. When it is desired to change colors, the flow of colorant material to the head 42 currently not in use is begun and the air cylinder is controlled to cause the shroud to be moved to the right as viewed in FIG. 7 to shield the moving insulated wire from the nozzles 46—46 and 50—50 of the head 58. The colorant material to the head 42 from which the shroud has been moved is sprayed by its associated nozzles onto the moving insulated wire. Shortly, afterwards, the flow of colorant material to the head 58 is discontinued.

Advantageously, the shroud arrangement may be used to facilitate the cleaning of the apparatus. When one of the heads 42 or 58 is not in use and its nozzles shrouded from the moving insulated wire, a cleaning liquid is flowed through the tubular members and nozzles of the unused head to clean them.

Figure 7:
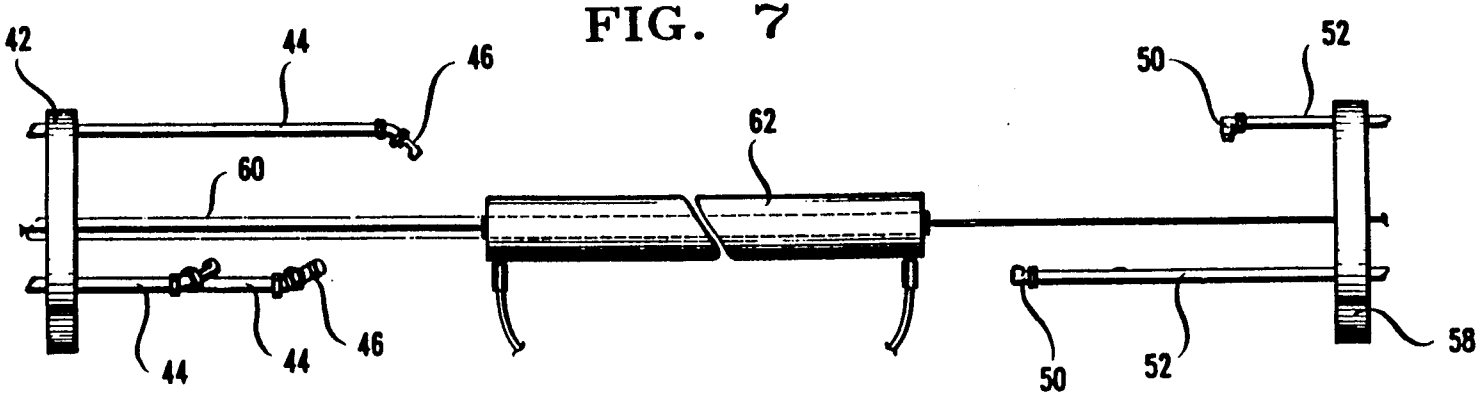
FIG. 7 is a front elevational view of a colorant application apparatus which includes provisions for changing colorant materials which are applied to a moving insulated metallic conductor.

Because of the cutover facilities of FIG. 7, a continuous length of insulated metallic conductor may have different colorant materials applied to successive portions of the length thereof. Subsequently, two portions of the insulated metallic conductor are separated from each other and the two portions twisted together by an apparatus well known in the art to provide an electrically matched pair manufactured on the same line and from a single run of an insulated metallic conductor with no other variables being introduced.

In the alternative, when the cutover apparatus of FIG. 7 is controlled to change from one application head to another, an automatic takeup apparatus is controlled to cause a cutover to another takeup reel after a predetermined time. That time is needed for the length of insulated conductor colored by the first head to be advanced onto one takeup reel before cutover to a second takeup reel. Subsequently, the two reels are mounted in a twisting apparatus (not shown) which is operated to cause the two lengths of differently colored conductor lengths to be twisted together.

As a result of the foregoing methods, an electrically matched twisted pair is provided. The insulation applied by the same extruder to successive portions of length of a metallic conductor and the colorant material applied to an outer surface of each insulated portion results in substantially equal dielectric constants between the two colored, insulated conductors. Of significant importance to the capability of distinguishing between two successive portions of the length of the metallic conductor is the ability to be able to shift quickly from the application of a form of identification to another such as the ability to change colorant materials quickly.

It is to be understood that the above-described arrangements are simply illustrative of the invention. Other arrangements may be devised by those skilled in the art which will embody the principles of the invention and fall within the spirit and scope thereof.

We claim:

1. An electrically matched, insulated metallic conductor pair which is suitable for the transmission of relatively high frequency signals, said conductor pair comprising:

first and second insulated metallic conductors each comprising;

a metallic conductor; and an insulation material which covers the metallic conductor;

said first insulated metallic conductor being distinguishable from said second insulated metallic conductor and the dielectric constant of the insulation material which is disposed about the metallic conductor of the first insulated metallic conductor and any identifiable marking associated therewith being substantially equal to the dielectric constant of the insulation material which is disposed about the metallic conductor of the second insulated metallic conductor and any identifiable marking associated therewith; and further said first and second insulated metallic conductors comprising successive portions of a continuous length of metallic conductor which has been insulated in a single run on a manufacturing line.

2. An electrically matched insulated metallic conductor twisted pair, which includes:

a first insulated metallic conductor, comprising:

a metallic conductor;

an insulation material which covers the metallic conductor; and a surface layer of a colorant material which is confined substantially to an outer surface of the insulation material; and a second insulated metallic conductor which is twisted together with said first insulated metallic conductor and which comprises:

a metallic conductor;

an insulation material which covers said metallic conductor of said second insulated metallic conductor; and a surface layer of a colorant material which is confined substantially to an outer surface of the insulation material of the second insulated conductor and which is distinguishable from the colorant material of said first insulated metallic conductor;

the confinement of the surface layer of colorant material of each insulated metallic conductor to an outer surface of the insulation material thereof being effective to maximize the distance from the metallic conductor of said each insulated metallic conductor to the colorant material;

the dielectric constant of the insulation material which is disposed about the metallic conductor of the first insulated metallic conductor and any identifiable marking associated therewith being substantially equal to the dielectric constant of the insulation material which is disposed about the metallic conductor of the second insulated metallic conductor and any identifiable marking associated therewith; and said first and second insulated metallic conductors comprising successive portions of a continuous length of metallic conductor which has been insulated in a single run on a manufacturing line.

3. The electrically matched pair of claim 2, wherein the insulation material of each insulated conductor is substantially non-porous.

4. The electrically matched pair of claim 3, wherein each said insulation material comprises a fluoropolymer plastic material.

5. The electrically matched pair of claim 2, wherein said insulation material of each insulated conductor is selected from the group consisting of perfluoroalkoxytetrafluoroethylene, fluorinated ethylene-propylene and ethylene tetrafluoroethylene copolymer.

6. The electrically matched pair of claim 2, wherein said surface layer of each insulated conductor comprises an ink.

7. The electrically matched pair of claim 2, wherein pigment variations of each said surface layer are spaced from the associated metallic conductor.

* * * * *